US005573068A

United States Patent [19]

Sharma et al.

[11] Patent Number: 5,573,068

[45] Date of Patent: Nov. 12, 1996

[54] APPARATUS FOR EXTINGUISHING FIRES IN OIL STORAGE TANKS

[75] Inventors: Tribhuvan P. Sharma; B. B. Lal; Jagbir Singh; R. S. Chimote, all of Roorkee, Ind.

[73] Assignee: Council of Scientific & Industrial Research, Rafi Marg, Ind.

[21] Appl. No.: 259,777

[22] Filed: Jun. 14, 1994

[51] Int. Cl.[6] ..... A62C 3/06

[52] U.S. Cl. ..... 169/68

[58] Field of Search ..... 169/5, 16, 17, 169/18, 66, 67, 68

[56] References Cited

U.S. PATENT DOCUMENTS

| | | | |
|---|---|---|---|
| 236,203 | 1/1881 | Campbell | 169/68 |
| 1,860,825 | 5/1932 | Thiede | 169/68 |
| 2,692,649 | 10/1954 | McCreary | 169/68 X |
| 3,644,073 | 2/1972 | Goldsmith | 169/68 X |
| 4,893,681 | 1/1990 | Flandre | 169/68 X |

FOREIGN PATENT DOCUMENTS

| | | | |
|---|---|---|---|
| 960330 | 4/1950 | France | 169/68 |

*Primary Examiner*—Andrew C. Pike
*Attorney, Agent, or Firm*—Pennie & Edmonds

[57] ABSTRACT

A device for extinguishing fires in a flammable liquid storage tank uses either foam or dry chemical powder, or both, as the extinguishant. The device comprises at least one annular pipe ring arranged in a horizontal plane just above the bottom of the storage tank and connected to a supply of extinguishant. When more than one ring is used, the rings are concentrically and equidistantly arranged with the outermost ring connected to the supply of extinguishant. The pipe rings have two or more diametrically connected cross-members. Vertically extending discharge pipes are situated at the junctions of the pipe rings and cross-members. The top ends of the discharge pipes are above the highest level of flammable liquid in the storage tank and are equipped with discharge nozzles. The discharge nozzles provide for uniform discharge of the extinguishant onto the surface of the flammable liquid held in the storage tank.

6 Claims, 2 Drawing Sheets

APPARATUS FOR EXTINGUISHING FIRES IN OIL STORAGE TANKS

BACKGROUND OF THE INVENTION

The present invention relates to a device for the extinguishment of fires by injecting foam and/or dry chemical powder and a fixed/floating roof storage tank incorporating the device.

The device of the present invention pertains to the oil and petrochemical industries from the viewpoint of fire protection of fixed/floating roof flammable liquid storage tanks.

The present state-of-the-art of extinguishment of oil fires in fixed/floating roof storage tanks implies use of foam and/or dry chemical powder.

In case of large scale fires in flammable liquid storage tanks, foam is practically used as an efficient fire extinguishing agent. Foam is an aggregate of air-filled bubbles formed from aqueous solutions and is lower in density than the lightest flammable liquids. Foam is known for its fire knock-down capability and for blanketing the flammable liquid surface on which it is applied. It is principally used to form a coherent floating blanket on flammable and combustible liquids lighter than water and prevents or extinguishes fire by excluding air and cooling the fuel. It also prevents reignition by suppressing formation of flammable vapors. It has the property of adhering to surfaces, providing a degree of exposure protection from adjacent fires. Foam may be used as a fire prevention, control, or extinguishing agent for flammable liquid storage tanks or processing areas. At present foam solution for these hazards is supplied by fixed piping arrangement either by top surface application or by subsurface/semi-subsurface application. The major drawback of the present top surface application methods is that these methods get damaged and thus render practically to be inefficient/ineffective when the roof of the tank gets blown off or otherwise when tank shell at the roof level gets deformed and/or damaged/buckled due to severe heat exposure during fire; and that of subsurface/semi-subsurface application is that the foam bubbles of the foam being injected carry along with them a part of the flammable liquid being embedded onto the bubble surface, resulting ultimately in the disintegration of foam bubbles at the top surface of the burning flammable liquid; thus jeopardizing the purpose for which it has been used.

Dry chemical powder extinguishant is used mainly for knocking down the flammable liquid fires. Dry chemical powder is a fine amorphous mixture which is used as a fire extinguishing agent. The principal base chemicals used in the production of currently available dry chemical extinguishing agents are sodium bicarbonate, potassium bicarbonate, potassium chloride, urea potassium bicarbonate, and monoammonium phosphate. Various additives are mixed with these base materials to improve their storage, flow, and water repellency characteristics. The most commonly used additives are metallic stearates, tricalcium phosphate, or silicones, which coat the particles of dry chemical powder to make them free flowing and resistant to the caking effects of moisture and vibration. Borax and sodium bicarbonate based dry chemical powder were the first such agents developed. Sodium bicarbonate became the standard agent because of its greater effectiveness as a fire extinguishing agent. About 1960, sodium bicarbonate based dry chemical powder was modified to render it compatible with protein based low expansion foams to permit a dual agent attack. Presently, there are five basic varieties of dry chemical extinguishing agents. Particles of dry chemical fire extinguishing agents range in size from less than 10 microns up to 75 microns. Dry chemical powder is stable at both low and normal temperatures. However, since some of the additives may melt and cause sticking at higher temperatures, an upper storage temperature limit of 49° C. is recommended for dry chemical powder, which in special cases may be acceptable up to 66° C. for very short durations. At fire temperature, the active ingredients either dissociate or decompose while performing their function in fire extinguishment. Of extreme importance is the danger caused by indiscriminate mixing of the various dry chemical powders. Fire tests on flammable liquids have shown potassium bicarbonate based dry chemical powders in extinguishment. Similarly, monoammonium phosphate has been found to be equal to or better than sodium bicarbonate in extinguishment effectiveness (Guise 1962). The effectiveness of potassium chloride is about equivalent to potassium bicarbonate, and urea-potassium bicarbonate exhibits the greatest effectiveness of all the dry chemical powders tested. At present, the dry chemical powder is intended for application by means of portable extinguishers, hand hose line system, or fixed systems. In all these cases, the dry chemical powder is introduced by top surface application methods. In fixed systems, they are fed by fixed piping arrangements. When applied directly to the fire area, dry chemical powder causes the flame to go out almost at once. Smothering, cooling, and radiation shielding contributes to the extinguishing efficiency of the chemical powders, but studies suggest that a chain-breaking reaction in the flame zone is the principal cause of extinguishment (Haessler 1974).

The drawbacks associated with the presently available devices are: combination of foam and dry chemical powder for extinguishment of flammable liquid fires in storage tanks is presently being used, either by top surface application or by subsurface/semi-subsurface applications. The drawback of top surface application is that when the roof of the fixed/floating roof tank gets blown off, the top surface application device(s) gets damaged and is unable to perform its function. In case of subsurface/semi-subsurface application, the foam bubbles carry along with them the flammable liquid and thus add to the fire and moreover the foam bubbles get broken off due to immediate heat contact and increase in the surface tension of the bubble surface because of the embedded flammable liquid; thus fueling the fire and, ultimately, rendering themselves ineffective in extinguishing the fire; whereas in case of the dry chemical powder, the major drawback is that it cannot be applied by using subsurface/semi subsurface application methods.

SUMMARY OF THE INVENTION

The object of the present invention is to obviate and remove the drawbacks of the presently available devices for top surface application, subsurface injection, and semi-subsurface injection.

Accordingly, the present invention provides a device for the extinguishment of fires by injecting foam and/or dry chemical powder, which comprises one or more annular pipe ring(s), capable of being fixed horizontally, concentrically and equidistantly to each other, just above the bottom of storage tank, the outermost annular pipe ring being connected to means for supplying foam and/or dry chemical powder, the annular pipe ring(s) having two or more diametrically connected cross-member pipes, the junctions of the annular pipe ring(s) and cross-member pipes being provided with vertical discharge pipes of height such that the top ends of the pipes are above the highest level of the flammable liquid in storage tank; the said vertical discharge pipes having discharge nozzles fixed to their top ends for uniform discharge of foam/dry chemical powder onto the flammable liquid surface in the tank.

In the device of the present invention, the number of annular pipe rings ranges from one to cube root or the nearest whole number, of the diameter of the storage tank in meters. The outermost annular pipe ring is fixed at a minimum distance of 1 meter from the storage tank wall. The annular pipe ring(s) is fixed at a distance in the range 0.15 m to 0.5 m from the bottom of the storage tank. The number of cross-member pipes is two times the number of annular rings. The height of the vertical discharge pipes is such that the top ends of the discharge pipes, to which are fixed the discharge nozzles, are at a distance ranging from 15 cm to 30 cm above the highest level of the flammable liquid in the storage tank. In case of injecting foam, the diameter of pipes for annular rings and cross-members will range from 150 mm to 250 mm, and for vertical discharge pipes from 100 mm to 200 mm. In case of injecting dry chemical powder, the diameter of pipes for annular rings and cross-members will range from 50 to 75 mm, and for vertical discharge pipes from 25 mm to 50 mm. The fire resistant/fire retardant material used for treating the annular pipe ring(s), cross-member pipes, vertical discharge pipes, discharge nozzles, valve, foam generator or a dry chemical powder discharge arrangement, and pipe fittings and accessories must have a fire resistance rating in the range of half-an-hour to one hour.

BRIEF DESCRIPTION OF THE DRAWINGS

The device of the present invention is explained with reference to the drawings accompanying this specification.

DETAILED DESCRIPTION OF THE INVENTION

Figure 1:
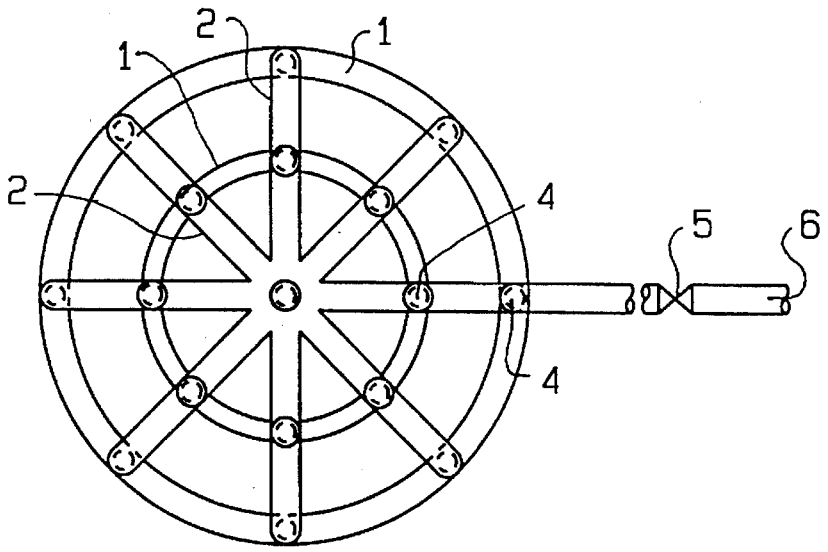
FIG. 1 shows the top view of the device.

The device of the present invention comprises at least one horizontally placed annular pipe ring(1). The number of annular pipe rings(1) depends on the diameter of the storage tank which is to be protected against fire hazards. The maximum number of annular pipe rings (1) is determined by the cube root, or the nearest whole number, of the diameter of the storage tank in meters. The diameter of the annuli will depend on the storage tank. The diameter of the annuli will depend on the storage tank(7) base diameter. The outermost annular pipe ring(1) is fixed at a minimum distance of 1 meter from the tank(7) wall. In the case of multiple annular pipe rings(l) the inner annular pipe rings (1) are being fixed equidistantly from each other. The annular pipe rings(1) are fixed horizontally at a distance in the range of 0.15 meter to 0.5 meter from the bottom of the storage tank(7). The annular pipe ring(s) (1) is/are connected diametrically by cross-member pipes(2) for uniform distribution of foam/dry chemical powder to all the vertical discharge pipes(3). The number of cross-member pipes(2) is two times the number of annular pipe rings(1). At the junctions of the annular pipe ring(s) (1) and the cross-member pipes(2) are fixed the vertical discharge pipes(3) for carrying and discharging the foam/dry chemical powder onto the surface of the flammable liquid(15) stored in the tank(7). The height of the vertical discharge pipes(3) is such that the top ends of the pipes(3) are in the range of 15 cm to 30 cm above the highest level (14) of the flammable liquid(15) in the storage tank (7). At the top ends of the vertical discharge pipes(3) are fixed the discharge nozzles (4) for uniform discharge of foam/dry chemical powder.

The type of discharge nozzles(4) used in the case of foam extinguishant is of the size ranging from 100 mm to 200 mm. The type of discharge nozzles (4) used in the case of dry chemical powder extinguishant is of the size ranging from 25 mm to 50 mm. The annular pipe ring(s) (1) is connected through a valve(5) to foam generator(s)(6) or a dry chemical powder discharge arrangement(6).

Figure 2:
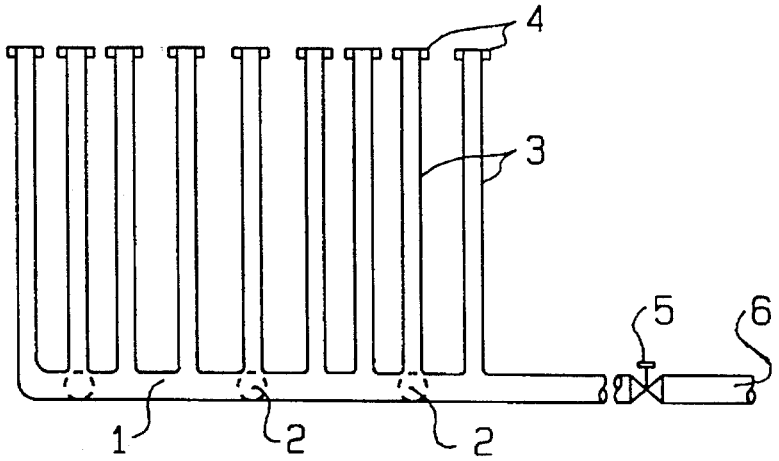
FIG. 2 depicts the front view of the device.
Figure 3:
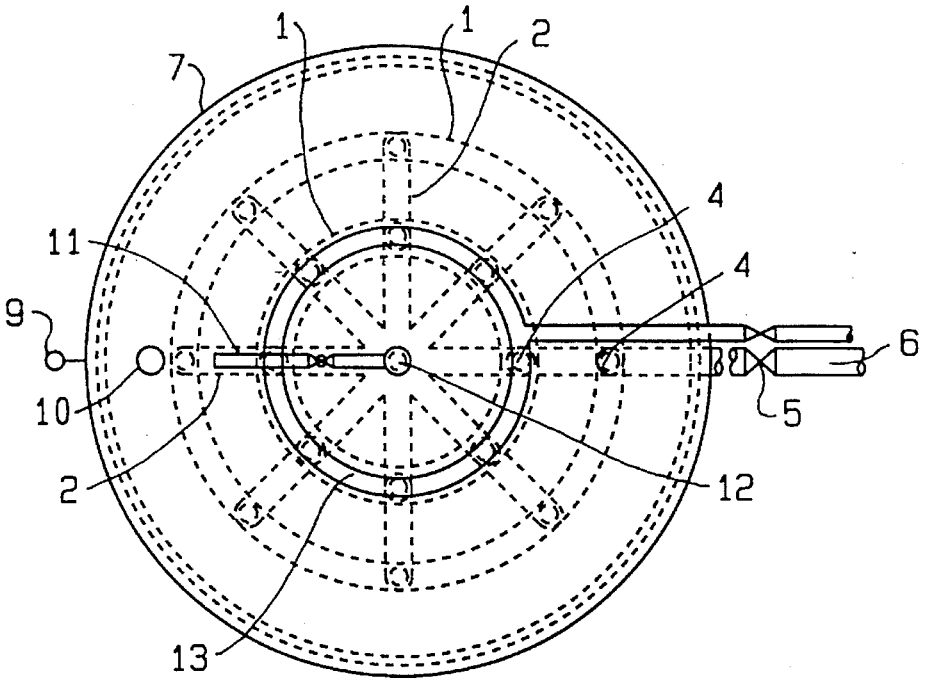
FIG. 3 shows the top view of the device installed in a flammable liquid storage tank.
Figure 4:
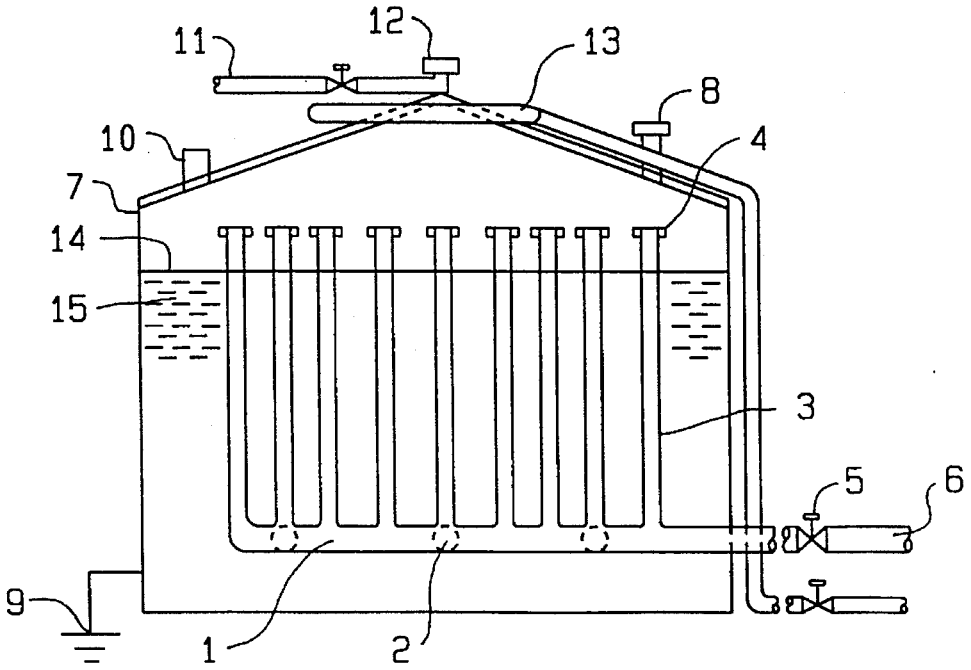
FIG. 4 depicts the front view of the device installed in flammable liquid storage tank.

The annular pipe ring(s) (1), cross-member pipes(2), vertical discharge pipes(3), discharge nozzles(4), valve(5), foam generator(s) (6) or a dry chemical powder discharge arrangement(6), and pipe fittings and accessories used in the construction of the device as shown in FIGS. 1, 2, 3, and 4 are treated with fire resistant/fire retardant material. The fire resistance rating of the fire resistant/fire retardant material used for the treatment is in the range of half an hour to one hour.

The device of the present invention as described above is installed inside the storage tank(7) containing flammable liquid(15). The other safety features in the tank include an emergency vent(8), conservation vent and flame arrester(12), gauge hatch(10), inert gas vent(11), earthing(9), and a water spray system (13) for the purpose of tank surface cooling so as to check the fire exposure hazard, and are the same as those used presently.

The device of the present invention is used as follows:

The device, as described above, is duly installed inside the storage tank(7) and connected to foam generator(s) (6)/dry chemical powder (DCP) discharge arrangement(6). The actuation of foam generator(s)/DCP discharge arrangement (6) is initiated automatically by rate-of-temperature rise/flame/heat sensors installed strategically inside the tank(7) to sense the occurrence of fire inside the tank(7) or manually by operating the power switch. As a result, in the event of fire the foam/DCP discharge occurs automatically and is uniformly distributed inside the tank (7) onto the surface (14) of the flammable liquid(15) stored in the tank (7) for the extinguishment of fire.

The device of the present invention can be installed for foam/dry chemical powder injection either singly or in combination depending upon the degree of fire hazards to be protected and the fire protection arrangement, therefore, required to be provided in order to accomplish the higher fire safety levels.

The following examples 1–9 are given to illustrate the present invention and should not be construed to limit the scope of the invention.

EXAMPLE 1

A flammable liquid storage tank of size: 2.5 m×4.35 m×1.0 m containing petrol was set on fire. The preburn time of 1 minute was given to allow the fire to develop fully. The device, having annular pipe ring and cross-member pipe of diameter 100 mm and the vertical discharge pipe and the nozzle of diameter 75 mm, was actuated to discharge foam gently through a foam discharge nozzle into a tank from a foam generator connected to it. The fire of size 10.0 sq. m was thus extinguished in 20 seconds.

EXAMPLE 2

The same set-up and procedure as given in example 1 was followed using diesel as a flammable liquid. The fire of size 10 sq. m. was extinguished in about 18 seconds.

EXAMPLE 3

The same set-up and procedure as given in example 1 was followed using kerosene as a flammable liquid. The fire of size 10 sq. m. was extinguished in about 18 seconds.

EXAMPLE 8

The same set-up and procedure as given in example 5 was followed using mobil oil as a flammable liquid. The fire of size 0.6 sq. m. was extinguished in about 8 seconds.

The salient features of the above experiments are shown in Table 1 and 2. From the above, it is clear that a fire in a flammable liquid storage tank can successfully be extinguished by using the device of the present invention in a short span of time ranging from 8 to 20 seconds.

TABLE 1

Salient features of the experiments carried out using foam as a fire extinguishing agent.

| S. NO. | EXTINGUISHING AGENT | FLAMMABLE LIQUID | SIZE OF TANK | SIZE OF FIRE (SQ. M) | EXTINGUISHMENT TIME (S) |
|---|---|---|---|---|---|
| 1. | Protein-based Foam | Petrol | 2.5 m × 4.35 m × 1 m | 10.0 | 20 |
| 2. | Protein-based Foam | Diesel | 2.5 m × 4.35 m × 1 m | 10.0 | 18 |
| 3. | Protein-based Foam | Kerosene | 2.5 m × 4.35 m × 1 m | 10.0 | 18 |
| 4. | Protein-based Foam | Mobil oil | 2.5 m × 4.35 m × 1 m | 10.0 | 18 |

TABLE 2

Salient features of the experiments carried out using dry chemical powder as a fire extinguishing agent.

| S. NO. | EXTINGUISHING AGENT | FLAMMABLE LIQUID | SIZE OF TANK | SIZE OF FIRE (SQ. M) | EXTINGUISHMENT TIME (S) |
|---|---|---|---|---|---|
| 1 | Sodium bicarbonate based dry chemical powder | Petrol | 0.9 m diameter × 0.75 m height | 0.6 | 10 |
| 2. | Sodium bicarbonate based dry chemical powder | Diesel | 0.9 m diameter × 0.75 m height | 0.6 | 8 |
| 3. | Sodium bicarbonate based dry chemical powder | Kerosene | 0.9 m diameter × 0.75 m height | 0.6 | 8 |
| 4. | Sodium bicarbonate based dry chemical powder | Mobil oil | 0.9 m diameter × 0.75 m height | 0.6 | 8 |

EXAMPLE 4

The same set-up and procedure as given in example 1 was followed using mobil oil as a flammable liquid. The fire of size 10 sq. m. was extinguished in about 18 seconds.

EXAMPLE 5

A flammable liquid storage tank of size: 0.9 m diameter× 0.75 m height containing petrol was set on fire. The preburn time of 1 minute was given to allow the fire to develop fully. The device, having annular pipe ring and cross-member pipe of diameter 20 mm and the vertical discharge pipe and the nozzle of diameter 16 mm, was actuated to discharge dry chemical powder(DCP) through a DCP discharge nozzle into a tank from a dry chemical powder discharge assembly connected to it. The fire of size 0.6 sq. m. was thus extinguished in 10 seconds.

EXAMPLE 6

The same set-up and procedure as given in example 5 was followed using diesel as a flammable liquid. The fire of size 0.6 sq. m. was extinguished in about 8 seconds.

EXAMPLE 7

The same set-up and procedure as given in example 5 was followed using kerosene as a flammable liquid. The fire of size 0.6 sq. m was extinguished in about 8 seconds.

Advantages of the device of the present invention are:

1. It is simple and economical in design, erection, and commissioning in actual field conditions for the fire protection of flammable liquid storage tanks of fixed/floating roof types.

2. It is capable of extinguishing flammable liquid storage tank fires more efficiently than various types of presently available devices.

3. By using the cheapest foam concentrate available in the market, it accomplishes the fire extinguishment successfully.

4. By using the cheapest dry chemical powder available in the market, it accomplishes the fire extinguishment successfully.

5. For 10.0 sq. m. size tank fire, foam device takes about 15–30 s to extinguish the fire completely.

6. For 0.6 sq. m. size tank fire, dry chemical powder device takes about 5–15 s to extinguish the fire completely.

7. It can be installed in the existing fixed/floating roof storage tank installations without difficulty.

We claim:

1. A device for extinguishing fires in a storage tank (7) by injecting at least one extinguishant from the group consisting of foam and dry chemical powder, said device comprising:

one or more annular pipe rings (1) fixed horizontally, concentrically and equidistantly from each other, inside and just above a bottom of said storage tank (7), an outermost annular pipe ring of said annular pipe rings being connected to means (5 and 6) for supplying said at least one extinguishant;

two or more cross-member pipes (2) diametrically connected across said annular pipe rings;

vertical discharge pipes (3) provided at junctions of said annular pipe rings and said cross-member pipes (2), top ends of said vertical discharge pipes being above a highest level (14) of a flammable liquid (15) in said storage tank (7); and discharge nozzles (4) fixed to said top ends for uniformly discharging said at least one extinguishant onto a surface of said flammable liquid (15) in said storage tank (7), wherein the number of said annular pipe rings is equivalent to the cube root of a diameter, in meters, of said storage tank.

2. A device for extinguishing fires in a storage tank (7) by injecting at least one extinguishant from the group consisting of foam and dry chemical powder, said device comprising:

one or more annular pipe rings (1) fixed horizontally, concentrically and equidistantly from each other, inside and just above a bottom of said storage tank (7), an outermost annular pipe ring of said annular pipe rings being connected to means (5 and 6) for supplying said at least one extinguishant;

two or more cross-member pipes (2) diametrically connected across said annular pipe rings;

vertical discharge pipes (3) provided at junctions of said annular pipe rings and said cross-member pipes (2), top ends of said vertical discharge pipes being above a highest level (14) of a flammable liquid (15) in said storage tank (7); and discharge nozzles (4) fixed to said top ends for uniformly discharging said at least one extinguishant onto a surface of said flammable liquid (15) in said storage tank (7), wherein the number of annular pipe rings is two.

3. A device for extinguishing fires in a storage tank, said device comprising:

at least two concentric annular pipe rings fixed horizontally, inside and just above a bottom of said storage tank;

a valve between an outermost annular pipe ring of said annular pipe rings and means for supplying extinguishant;

at least two cross-member pipes diametrically connected across said annular pipe rings;

vertical discharge pipes provided at junctions of said annular pipe rings and said cross-member pipes, top ends of said vertical discharge pipes rising above a highest level of flammable liquid in said storage tank; and discharge nozzles fixed to said top ends for uniformly discharging said extinguishant onto a surface of said flammable liquid.

4. A device as claimed in claim 3, wherein said annular pipe rings are fixed at a distance between 0.15 and 0.5 meters above said bottom of said storage tank.

5. A device as claimed in claim 3, wherein the outermost annular pipe ring is fixed at a minimum distance of 1 meter from a wall of said storage tank.

6. A device as claimed in claim 3, wherein the discharge nozzles are 15 cm to 30 cm above said highest level.

* * * * *